US010575620B2

(12) United States Patent
Arredondo

(10) Patent No.: US 10,575,620 B2
(45) Date of Patent: Mar. 3, 2020

(54) APPLICATOR WITH INTERCHANGEABLE WANDS

(71) Applicant: Melissa Ann Arredondo, Buffalo, WY (US)

(72) Inventor: Melissa Ann Arredondo, Buffalo, WY (US)

( * ) Notice: Subject to any disclaimer, the term of this patent is extended or adjusted under 35 U.S.C. 154(b) by 145 days.

(21) Appl. No.: 15/685,143

(22) Filed: Aug. 24, 2017

(65) Prior Publication Data

US 2018/0055194 A1 Mar. 1, 2018

Related U.S. Application Data

(60) Provisional application No. 62/381,058, filed on Aug. 30, 2016.

(51) Int. Cl.

| | |
|---|---|
| ***A46B 7/04*** | (2006.01) |
| ***A45D 34/04*** | (2006.01) |
| ***A45D 33/00*** | (2006.01) |
| ***A45D 40/26*** | (2006.01) |
| ***A46B 9/02*** | (2006.01) |

(52) U.S. Cl.

CPC ..... *A45D 34/046* (2013.01); *A45D 33/00* (2013.01); *A45D 40/267* (2013.01); *A46B 7/042* (2013.01); *A46B 7/048* (2013.01); *A46B 9/021* (2013.01); *A46B 2200/1053* (2013.01)

(58) Field of Classification Search

CPC .... A45D 34/045; A45D 34/046; A46B 7/042; A46B 7/046; A46B 7/048

USPC ..... 401/118–130

See application file for complete search history.

(56) References Cited

U.S. PATENT DOCUMENTS

| | | | | |
|---|---|---|---|---|
| 7,481,592 | B2 * | 1/2009 | Gueret | A45D 34/04 401/122 |
| 2002/0168214 | A1 * | 11/2002 | Carullo | A45D 40/265 401/129 |
| 2012/0325235 | A1 * | 12/2012 | Bouix | A45D 40/265 132/200 |

* cited by examiner

*Primary Examiner* — David J Walczak
*Assistant Examiner* — Joshua R Wiljanen
(74) *Attorney, Agent, or Firm* — Andra M Vaccaro, Esq.

(57) ABSTRACT

An apparatus for dispensing liquid, powder, gel, goop or other viscous preparations requiring applicators, such as, without limitation, mascara, lip coverings, eyeliners, eye shadows, eyebrow products, glues, medications and the like is disclosed. The apparatus is comprised of a cap comprising a receptacle for receiving a wand, having means for temporarily coupling the wand at one end with the receptacle and an applicator head on the opposite end. Depending on use, the application head may be a brush, pad, molded bristle brush, flat brush or the like. The apparatus may be used to apply lipstick, glue, medication, gels, goops, viscous preparations, powders and the like. After use, the applicator wand can be removed and another wand can be interchanged into the same cap for another use or application. In an alternate embodiment, to manage the varying applicator heads, a custom wiper may be fitted into the neck of the base containing the liquid/powder/gel. In another embodiment, the wiper is flexible to self-adjust to each applicator head currently being used.

17 Claims, 3 Drawing Sheets

APPLICATOR WITH INTERCHANGEABLE WANDS

RELATED APPLICATION

This application claims the benefit of U.S. Provisional Application No. 62/381,058 filed on Aug. 30, 2016, the entire disclosure of which is incorporated herein by reference as though set forth fully herein.

COPYRIGHT NOTICE

To the extent that any portion of the disclosure of this document contains material that is subject to copyright protection, the copyright owner does not object to the copying this document or patent disclosure as it appears in the U.S. Patent and Trademark Office records, but reserves all of its copyright rights therein.

FIELD OF THE INVENTION

The present relates to self-contained applicators of liquids, powders, gels and the like that allows the user to easily change the applicator head that is used to apply the liquid, powders, gels and the like. More specifically, the invention relates to apparatuses that may be used to apply liquid, powder or gel cosmetics, liquid, gel or powder medications, or used to apply liquid glues and/or other viscous materials and the like to various surfaces.

BACKGROUND OF THE INVENTION

Currently in the cosmetic, nail, construction and medicine fields, there are many applicators that may be used to apply liquids, powders, gels and other viscous materials. By way of example and not limitation, in the cosmetic industry, mascara, eyeliner, eye shadow, lipstick and the like use wand applicator brushes and applicator pads which can be dipped into tubes or jars of liquid, powder and gels and the like and then applied to the user's face. Mascara, for example, may come in a two part substantially cylindrical tube, wherein the mascara is located in the bottom part of the tube, while the applicator brush is permanently affixed to the top (cap) of the tube. When not in use, the top of the tube containing the applicator is screwed onto the bottom part of the tube, such that the applicator is stored within the mascara in the bottom. Likewise, in the medicine field, there are both prescription and over-the-counter liquid medications and glues that come in containers that have applicators affixed to the top cover which are used to apply the medication or glue to the proper site. In addition, in the construction and other related fields, there are glues and other goopy and/or viscous product containers that require applicators to apply the glue or other viscous product to a surface.

In all of these applications, the original self-contained permanently affixed applicator that accompanies the product may not be the best size, shape or the preferred configuration for either the application or the user or both. In addition, among other known issues, applicator tips may wear out, have too much residue from prior use(s), lose their sterility or become contaminated, such that the remaining contents may no longer be accessible and ultimately gets discarded.

In addition, mascara and other cosmetics usually come with specific applicators that can be any number of shapes. By way of example, and not limitation, there are mascaras or brow gel products that contain differently configured brushes that may either create length, volume, or the curling of the eyelashes or for the filling in of the brow. For someone wishing to be able to achieve all of these benefits, a user must either purchase multiple tubes of product (such as, by way of example and not limitation, mascara or brow gel) or numerous different unique shaped brush wands. In order to have a portable mascara, unless the tube comes with the desired wand applicator, the user may not be able to switch the existing wand cap of one mascara to another wand cap containing a brush shape that the user prefers, as the cap containing a wand from one brand of product or even from the same brand of product may not be not interchangeable. The same may be true of medications, glues and other viscous products which need an applicator head to be applied. Likewise, with these products the neck of one product container may not match the size and shape of another product cap containing a different applicator from another container.

Further, using a new or different applicator head affixed to a cap from one brand may not fit into the container of another or the same brand of product. Many times, if another applicator tip is preferred or desired, it must be carried loose which could cause contamination of the applicator tip or of the product itself. Therefore it would be advantageous in the art to provide a liquid, powder and/or gel container in which the applicator heads/wands in the caps can be replaced.

SUMMARY OF THE INVENTION

In a preferred embodiment of the present invention there is a cap that contains a receptacle designed to receive and temporarily lock a reciprocal connector in place in the receptacle. The reciprocal connector is located on one end of an axial wand or rod that has an applicator head permanently affixed to the opposite end of the wand or rod. The applicator head may be a stiff, fluffy, large, small, curved, flat, molded, pointed, straight, bristled or bent brush; a stiff, fluffy, or foamy applicator pad; or be comprised of any other applicator head that is known in the art and used with liquid and gel applications.

In a preferred embodiment, the receptacle in the cap is threaded along the inside wall. The reciprocal connector on the wand is correspondingly threaded on the outside so that the connector on the wand can be threaded into the receptacle in the cap to temporarily lock the wand in place in the cap. In an alternate preferred embodiment, the receptacle within the cap may have arms, knobs or extensions and/or the like on the inside or bottom thereof and the connector on the wand has a corresponding channel, slots, indentations or the like located on the outside wall thereof. The wand can then be temporarily locked into place in the cap by twisting or pushing the wand or cap to capture so that the arms, knobs, extensions and/or the like in the cap are captured by the reciprocal structure (channel, slots, indentations or the like) on the wand. In yet another alternate embodiment, the receptacle in the cap has indentations or slots and the connector on the wand has corresponding knobs, arms or extensions so that after inserting the connector on the wand into the receptacle, a single twist of the wand will temporarily lock the wand securely into place in the receptacle in the cap. Any known means of connecting can be used so long as it will temporarily lock the male connector in place in the female receptacle in the cap for later removal.

In a preferred embodiment of the invention, there is an elongated longitudinal base, which is closed as the distal end and is substantially hollow. It is the hollow part of the base that contains and stores the liquid, powder, gel, goop or other viscous product and into which the wand attached to the cap may be temporarily and removably stored. When the present invention is not in use, the cap is temporarily secured to the base using well known methods in the art such as, without limitation, screwing the cap onto the base, snapping the cap onto the base, etc. so that the contents of the base is fully secured when the cap is secured to the base and a secure seal is formed between the cap and the base. In a preferred embodiment, a base is configured so that any applicator head and wand temporarily affixed to the cap may be inserted into the base hollow for transport, storage and use. In a preferred embodiment, the base can be any shape so long as it is deep enough to contain a wand affixed to the cap therein and the cap can be taken on or off without disturbing the applicator head. In a preferred embodiment of the present invention, there is a flexible wiper system that is permanently affixed around the insider circumference of the hollow at the neck of the base. This wiper system is designed to remove excess liquid, powder, gel, goop and the like from the applicator head, regardless of size. In a preferred embodiment, the wiper will ensure no excess product is left on the respective wand to prevent clumpy application. The wand also can be any shape, cylindrical, square, rectangular or some combination of same and, although axial in a preferred embodiment, the rod may be curved or bent into any shape so long as it can be contained wholly within the base.

In a preferred embodiment of the present invention, wands with varying brush heads containing male connectors will be sold in packs or separately to allowing complete customization based on personal preference of the user.

DETAILED DESCRIPTION OF THE DRAWINGS

Figure 1:
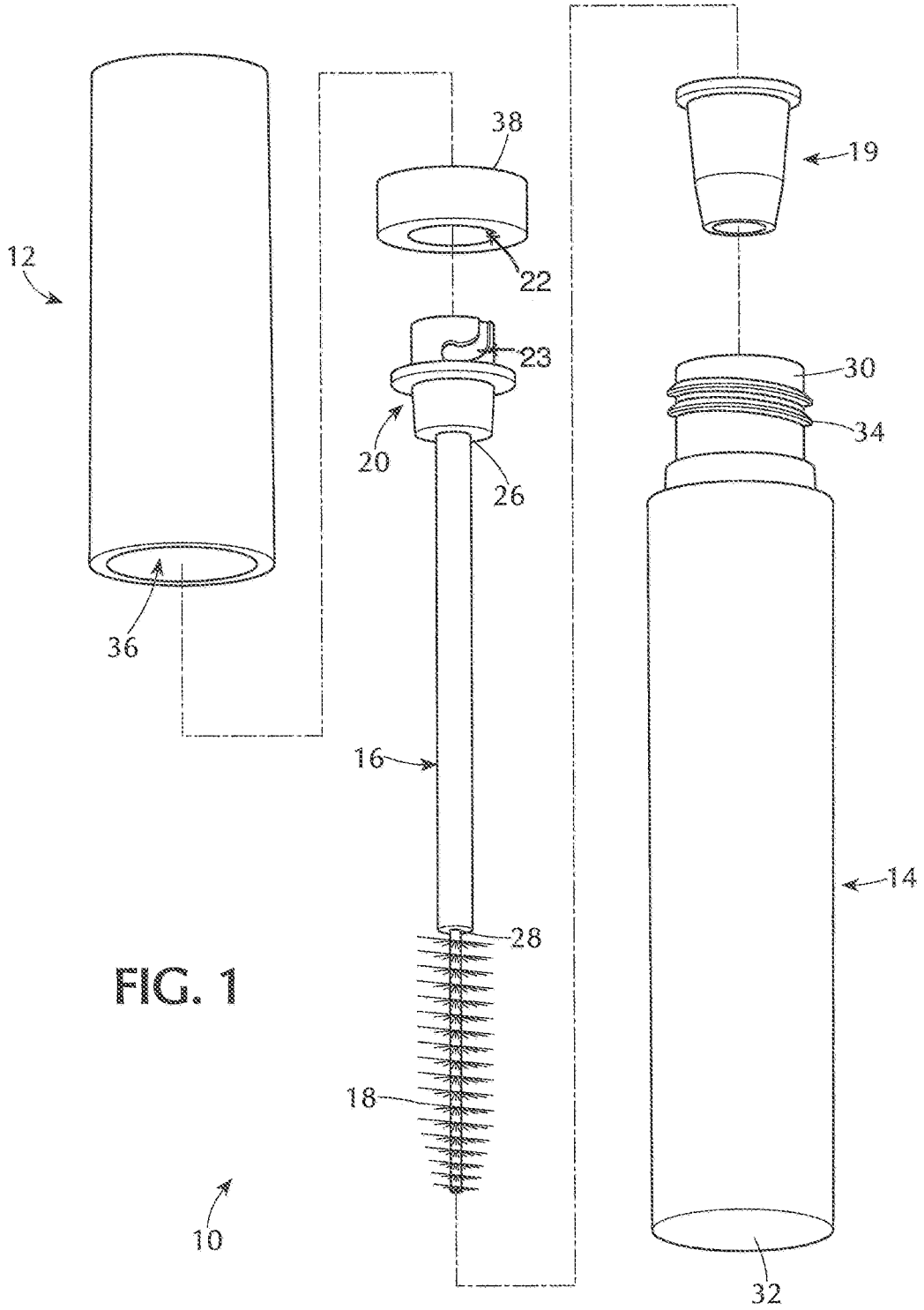
FIG. 1 is a exploded perspective view of the apparatus of a preferred embodiment of the present invention.

In the following descriptions of the invention, terms such as "top", "bottom," "first end" and "second end", "horizontal", "longitudinal", and the like are used herein merely for ease of description and refer to the orientation of the components shown in the FIGURES and are not meant to limit the invention in any way. Throughout all the FIGURES, like numerals refer to like parts such that corresponding elements are generally indicated by same reference numerals. The embodiments depicted herein are illustrative of the invention and are not meant to limit the invention in any way. It should also be understood that the drawings are not necessarily to scale and that the embodiments are sometimes illustrated by diagrammatic representations and by fragmentary views. In certain instances, details, which are not necessary to understand the present invention or which render other details difficult to perceive, may have been omitted.

Figure 2:
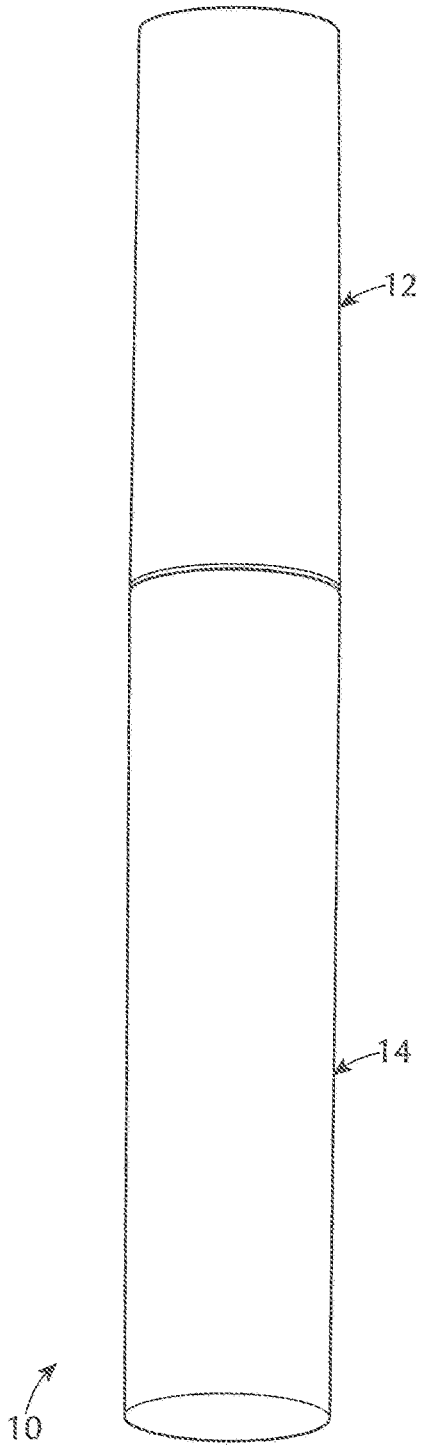
FIG. 2 is a perspective view of a preferred embodiment of the present invention in a closed position.
Figure 3:
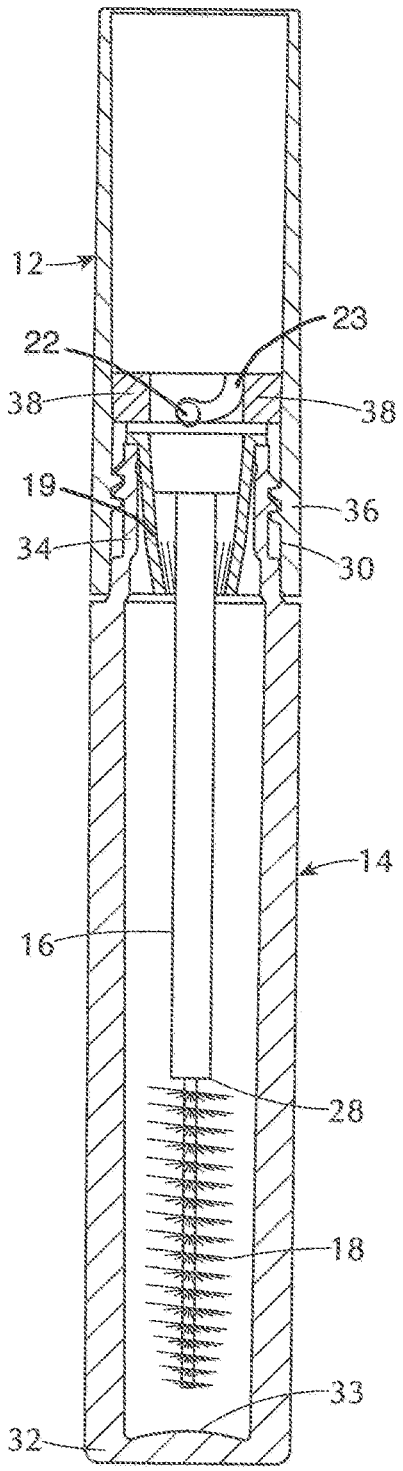
FIG. 3 is a cross sectional view of a preferred embodiment of the present invention shown in FIGS. 1 and 2.

Generally the invention may be described as follows. Referring first to FIGS. 1-3, a preferred embodiment of the present invention is shown as it is used in connection with cosmetics and more particularly mascara. In FIG. 1, the apparatus 10 of the present invention comprises a cap 12 and a contents base 14 and a wand 16 (shown in FIG. 2) having an applicator head 18 at one end 28 and a connector 20 on the other end 26. In this illustrated embodiment, the contents base 14 has a generally cylindrical main body and the cap 12 has a cylindrical main body, the relative length of each being a preference of the manufacturer. When the invention is used for medical or construction applications, the relative shapes and sizes of the cap 12 and base 14 may change depending on the contents of the base 14 and the length of the wand 16. For example, the base and cap may be rectangular or any other complementary shapes.

In a preferred embodiment of the present invention, the base 14 also includes a flexible wiper system 19 (as shown in FIGS. 1 and 3) affixed at or near the neck 30 of the base 14 for wiping any excess content off of the applicator head 18. Specifically, a flexible wiper system 19 may be permanently affixed around the insider circumference of the neck 30 of the base 14 or it may be an accessory piece 19 that can be inserted into the neck 30 of the base 14 and locked therein or glued in place. This wiper system 19 is designed on the inside to remove excess liquid, powder, gel, goop and the like from the applicator head 18, regardless of its size, configuration, or shape. In a preferred embodiment, the wiper will ensure no excess product is left on the respective wand to prevent clumpy application.

The contents base 14 is open at neck 30 and it is through this opening that the contents of the base may be accessed. The contents base 14 has a closed end 32 so that the contents may be held within the base 14. The cap 12 is designed to secure the contents of the base 14 when the cap 12 and bottom 14 are in a completely closed position as is shown in FIGS. 2 and 3. In a preferred embodiment, the cap 12 may have threads 36 proximate the inside of the neck 30 so that it can be screwed onto the corresponding threads 34 of the contents base 14, but any method known in the art of temporarily securing the cap 12 to the base 14 so that it may be opened and closed, may be used.

Referring more particularly to FIGS. 2 and 3, a preferred embodiment of an apparatus 10 according to the present invention is shown. In the preferred embodiments shown in FIGS. 1-3, the apparatus is configured for mascara. However, by changing the applicator wand 16 to a different wand with a different applicator head 18, the apparatus 10 could be used to contain and apply lipstick, lip gloss, eye shadow, eyebrow gloss or any other cosmetic. In addition, with additional modifications, the apparatus 10 could be used to contain and apply glue, medicine or any other viscous material that needs to be applied via an applicator. The only limitation to the apparatus is that the base 14 whether a tube, bottle, jar, container, etc. be configured so as to be able to properly enclose the wand 16 with the applicator head 18, which is secured to the cap, within the contents contained within the base 14. Alternatively, the length of wand 16 is chosen so that at least the applicator head 18 is proximate to the inside bottom surface 33 of base 14.

In a preferred embodiment of the present invention as shown in FIGS. 1 and 3, the cap 12 contains a receptacle 38 designed to receive and temporarily lock a reciprocal connector 20 attached to wand 16 in place. Specifically, the receptacle 38 in the cap contains an arm or an extension 22 which may be inserted into indentation or channel 23 in the connector 20 for temporarily locking the connector in place.

The connector 20 is located at one end 26 of an axial wand 16 that has an applicator head 18 permanently affixed to the opposite end 28. The applicator head 18 may be a stiff, fluffy, large, small, curved, flat, molded, pointed, straight, bristled or bent brush, a stiff, fluffy, or foamy applicator pad, or be comprised of any other type and shaped applicator head that is known in the art. The wand 16 can be any shape, cylindrical, square, rectangular or some combination of same. In a preferred embodiment shown in the FIGURES, the applicator head 18 is shown as a straight bristled brush. However, the rod may be any configuration so long as it can fit easily within a base 14.

Figure 5:
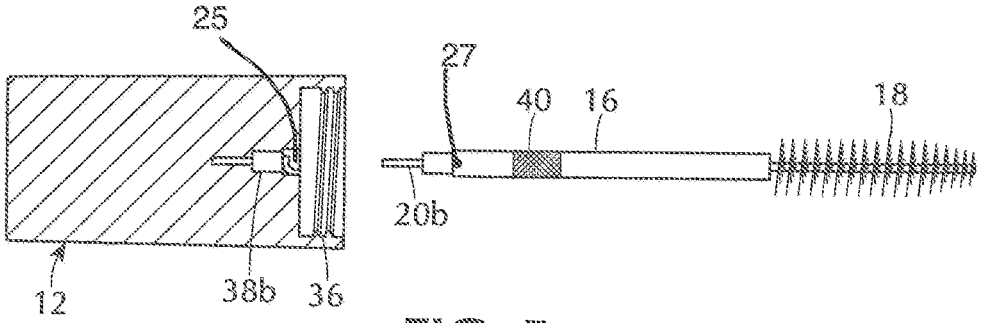
FIG. 5 is a partial cross sectional side view of an alternate preferred embodiment of a cap and wand of the present invention.
Figure 6:
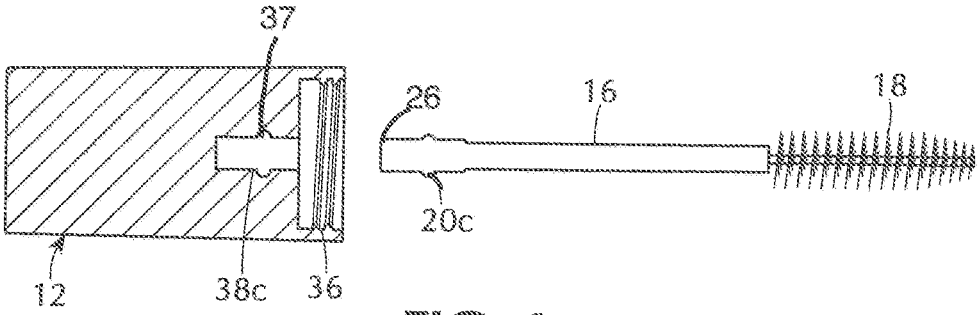
FIG. 6 is a partial cross sectional side view of another alternate preferred embodiment of a cap and wand of the present invention.

In a preferred embodiment as shown in FIGS. 1 and 3, as well alternate embodiments shown in FIGS. 5 and 6, the receptacle 38 in the cap 12 and the connector 20 on the wand 16 are designed so that a single twist of the wand 16 in one direction may temporarily lock the wand 16 securely into place in the receptacle 38 in the cap 12. Likewise, a single twist of the wand 16 in the opposite direction will unlock the wand 16 from the cap 12. Specifically, as shown in FIGS. 1 and 3, a single twist and lock connector 20 on the wand is received by an equal but opposite single twist and lock receptacle 38 to temporarily lock the wand 16 to the component cap 12. A prospective external view of a twist and lock connector 20 that is affixed to the distal end of wand 16 is shown in FIG. 1, as is a prospective external view of the receptacle 38 located in the cap 12.

Figure 4:
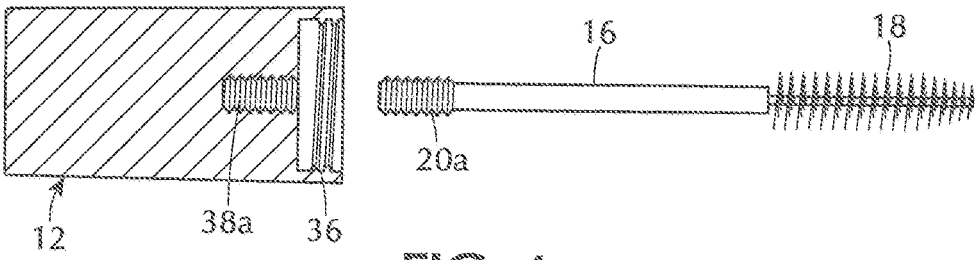
FIG. 4 is a partial cross sectional side view of a preferred embodiment of a cap and wand of the present invention.

In an alternate preferred embodiment shown in FIG. 4, there is no separate receptacle 38 in the cap 12 as the cap is threaded along the inside wall 38*a*. Likewise, there is no reciprocal connector on the wand 16. Rather, the outside of wand 16 is threaded with a thread corresponding in size and shape so that it may be tightly threaded into the inside wall 38*a* of the cap 12 to temporarily screw and lock the wand 16 in place in the cap 12. By unscrewing threaded end 20*a* of the wand 16 from the threads 38*a* in the cap 12, the wand 16 can be unlocked, removed and replaced.

In yet another alternate preferred embodiment, the cap 12 contains a permanent connector receptacle 25 that is similar to the twist and lock connector 20*b* shown in FIG. 1. In an alternative embodiment, such as shown in FIG. 5, the cap 12 also has a hole 38*b* in addition to receptacle 25 which corresponds to the size and shape of the end of the wand. In addition, the wand has an extender arm that is inserted into the lock connector 20*b* in the cap. Specifically, a simple insertion and twist of wand 16 into the hole 38*b*, will cause the extender arm 27 to enter the corresponding slot in the connector 20*b* and lock the wand 16 into place in cap 12.

In yet a further alternate embodiment as shown in FIG. 6, the cap 12 contains a hole 38*c* with one or more indentations 37 in its wall. Wand 16 may have corresponding extensions 20*c* on the external wall proximate its end 26 or it may contains a connector (not shown) with corresponding extensions 20*c*. The wand 16 then may be inserted into the hole 38*c* and twisted to cause the extender(s) 20*c* to enter corresponding indentations 37 in the hole 38*c* in the cap 12 to lock the wand 16 into place in cap 12.

In FIGS. 1, 3, 5 and 6 in lieu of the extensions, arms, knobs, retractable extensions or the like may be used, so long as there are corresponding slots or indentations located in the corresponding piece so that the wand 16 can be temporarily locked into the cap 12. Likewise, any receptacle 22 can be used in the cap 12 to temporarily lock a corresponding connector 20 on the wand 16 so long as the wand 16 may be removed and replaced. When the wand 16 is securely connected to the component cap 12, the wand 16 can be inserted applicator head first into the base 14 or bottle (not shown) containing the product contents.

In all embodiments of the present invention, a non-slip coating or non-slip pad 40 (shown in FIG. 5) may be used on the wand 16 so that it will be easier to grab.

When the user is ready to use the apparatus of the present invention, the user simply removes the cap 12 from the open end of the base 14 and selects a wand 16 with an applicator head designed for their preferred usage. By way of example and not limitation, when the apparatus 10 of the present invention is used for mascara, the user selects a wand 16 having a brush designed for their preferred finished look, then the cap 12 is removed from the base 14 and the user would attach the selected wand 16 and lock it into place in the receptacle 22 inside the cap 12. Once secured, the applicator head is ready to be inserted into the open end of the contents base containing the mascara formula and applied to lashes, brows, or other area as desired. If a flexible wiper system 19 is installed in the base, the wand is directed through the center of the wiper system, wands can be changed out while using the same formula base. The user simply unlocks the wand in the cap, cleans it and returns it to a storage container, then temporarily secures the preferred wand into the cap that may then be dipped into the contents so that the user can apply the contents with the new applicator head.

While particular embodiments and methods of the present invention have been shown and illustrated herein, it will be understood that many changes, substitutions and modifications may be made by those persons skilled in the art. It will be appreciated from the above description of presently preferred embodiments and methods that other configurations and techniques are possible and within the scope of the present invention. Thus, the present invention is not intended to be limited to the particular embodiments and methods specifically discussed hereinabove.

What is claimed is:

1. An apparatus for dispensing cosmetics liquid or powder to be applied, comprising:

a base having an inside hollow area and a proximate end and a distal end, wherein the base has a neck at the proximate end and wherein the base contains cosmetics liquid or powder in the inside hollow area of the base between the neck and the distal end, a removable cap having an inside wall and a neck portion having an inner receptacle comprising an extender extending therefrom, the cap capable of being temporarily affixed to the neck of the base, whereby when the cap is temporarily affixed to the base, the contents of the base will not spill out, a wand, having a proximate end and a distal end, an applicator head attached to the proximate end of the wand, a connector permanently affixed to the distal end of the wand, wherein the connector comprises a channel having an open end for receiving the extender extending from the receptacle within the neck of the cap, the channel being substantially hook-shaped and further comprising a channel locking mechanism such that when the extender enters the channel at the open end and traverses it to the opposite end thereof, by using a vertical motion followed by a horizontal motion, the extender on the wand will become temporarily locked within the hook-shaped channel by the locking mechanism so as to lock the wand into place in the cap so that the wand cannot become unlocked by merely turning the base, whereby when a new wand is desired or needed, the wand may be removed by using a horizontal and then a vertical motion which disengages the extender in the neck of the cap from the locking mechanism in the connector so that the wand may be removed from the cap, and a new wand containing a new applicator head and a new connector may be installed in its place.

2. The apparatus of claim 1, whereby the receptacle in the cap and the connector on the wand are designed so that a vertical force on the connector followed by a single twist of the wand in a horizontal direction will temporarily lock the wand into place within the cap and a single twist of the wand in the horizontal direction opposite to the horizontal direction used to lock the wand in place followed by a vertical force in a direction opposite to the direction used to lock the wand in place will unlock the wand for removal from the cap.

3. The apparatus of claim 1, wherein the applicator head is a stiff, fluffy, large, small, curved, flat, molded, pointed, straight, bristled or bent brush, a stiff, fluffy, or foamy applicator pad or be comprised of any other applicator head known in the art.

4. The apparatus of claim 1 wherein the cap is temporarily secured to the base by either screwing the cap onto the base, the cap being twisted and locked onto the base, or the cap being snapped onto the base, whereby the contents of the base is fully secured when the cap is secured to the base and a secure seal is formed between the cap and the base.

5. The apparatus of claim 1 wherein the base is configured so that the applicator head and wand temporarily affixed to the cap may be inserted into the base contents for transport, storage and use.

6. The apparatus of claim 5 wherein the base can be any shape so long as along its longitudinal axis it is deep enough to contain the entire wand while it is affixed to the cap when the cap and the base are affixed to each other.

7. The apparatus of claim 1 further comprising a flexible wiper system affixed within the neck of the base whereby when the applicator head is pulled out of the contents of the base, it is pulled through the flexible wiper system, whereby any excess contents on the applicator head is removed.

8. An apparatus for dispensing liquids, viscous materials, medication, glues, or powders to be applied to a surface, comprising:

a base having an open neck, wherein the base contains a liquid, a viscous material, a medication, a glue, or a powder to be applied to a surface, a removable cap having a proximate and a distal end and an inside surface, the cap being capable of being temporarily affixed at its proximate end to the base proximate the neck of the base, whereby when the cap is affixed to the base, the contents of the base will not spill out, a wand having a proximate end and a distal end, an applicator head attached to the proximate end of the wand, at least one connector permanently affixed to the distal end of the wand, the connector extending from or proximate to the distal end of the wand, receptacle comprising an inner wall and an outer wall whereby the outer wall is attached to the inside surface of the cap at its proximate end, the inner wall of the receptacle comprising a vertical and a horizontal part, the vertical part capable of receiving the connector at one end, the horizontal part comprised of a locking structure at the end furthest from the vertical part, embedded in the cap proximate its neck and capable of temporarily locking the connector on the wand into place into the cap such that the wand will not come undone merely by rotating the wand or cap horizontally, whereby the user removably affixes the wand to the cap by vertically inserting the connector into the receptacle and thereafter turning it horizontally until it reaches the locking structure to temporarily lock the connector in the receptacle in the cap and whereby when a new wand is desired or needed, the prior wand may be removed by unlocking the connector from the receptacle by turning it horizontally in a direction opposite to the horizontal direction used to lock the connector into the locking structure followed by a vertical force to drive the connector out of the vertical part of the receptacle, whereby a new wand containing a new applicator head and a new connector may be installed in its place.

9. The apparatus of claim 8, whereby the receptacle comprises a vertical channel having an opening at one end to receive the connector, and a horizontal locking portion at the end opposite the open end, and wherein the connector is shaped so that it can easily slid within the channel and easily be temporarily locked within the locking portion of the channel.

10. The apparatus of claim 8, whereby the receptacle has slots or indentations through the sides or bottom thereof into which an arm, knob, extension located on the outside of the connector are placed to temporarily lock the connector into place in the receptacle in the cap.

11. The apparatus of claim 8, whereby the receptacle and the connector are designed so that both a vertical force and a horizontal force are necessary to temporarily and securely lock the connector in place in the locking portion of the channel and a horizontal force and a vertical force in the opposite direction will unlock the connector from the locking portion, so that 4 the wand may be removed and replaced at a later time.

12. The apparatus of claim 8, wherein the applicator head is a stiff, fluffy, large, small, curved, flat, molded, pointed, straight, bristled or bent brush, a stiff, fluffy, or foamy applicator pad or be comprised of any other applicator head known in the art.

13. The apparatus of claim 8 wherein the cap is temporarily secured to the base, by either screwing the cap onto the base, the cap being twisted and locked onto the base, or the cap being snapped on the base so that the contents of the base is fully secured when the cap is secured to the base and a secure seal is formed between the cap and the base.

14. The apparatus of claim 8 wherein the base is configured so that the wand which is temporarily affixed to the cap may be fully inserted into the base when the base is attached to the cap for transport, storage and use.

15. The apparatus of claim 14 wherein the base comprises a longitudinal axis that is deep enough to contain a wand affixed to the cap.

16. The apparatus of claim 8 further comprising a flexible wiper system that is permanently affixed within the neck of the base whereby when the applicator head is pulled out of the contents of the base, it is pulled through the flexible wiper system, such that any excess contents on the applicator head may be removed.

17. The apparatus of claim 8 wherein the wand has a non-slip area thereon between the head and the connector.

* * * * *